US006082473A

United States Patent [19]

Dickey

[11] Patent Number: 6,082,473

[45] Date of Patent: Jul. 4, 2000

[54] DRILL BIT INCLUDING NON-PLUGGING NOZZLE AND METHOD FOR REMOVING CUTTINGS FROM DRILLING TOOL

[76] Inventor: Winton B. Dickey, Rte. 2 Box 86, Alvin, Tex. 77511

[21] Appl. No.: 09/084,066

[22] Filed: May 22, 1998

[51] Int. Cl.[7] ..... E21B 10/00; E21B 10/14

[52] U.S. Cl. ..... 175/340; 175/339; 175/393; 175/424; 166/222; 166/223; 239/591

[58] Field of Search ..... 175/424, 393, 175/339, 340; 166/222, 223; 239/552, 559, 591

[56] References Cited

U.S. PATENT DOCUMENTS

| | | | |
|---|---|---|---|
| 823,749 | 9/1906 | Wanner | 175/424 X |
| 1,656,471 | 1/1928 | Childs et al. . | |
| 2,117,648 | 5/1938 | Bottorf | 166/222 X |
| 2,137,261 | 11/1938 | Boll et al. . | |
| 2,260,487 | 10/1941 | Scott | 175/340 |
| 2,327,051 | 8/1943 | Lyons et al. | 166/222 |
| 2,719,026 | 9/1955 | Boice . | |
| 2,869,631 | 1/1959 | Zink | 239/559 X |
| 3,070,182 | 12/1962 | Runte . | |
| 3,655,001 | 4/1972 | Hoffman . | |
| 3,934,659 | 1/1976 | Tsiferov . | |
| 4,050,529 | 9/1977 | Tagirov et al. | 166/223 X |
| 4,082,015 | 4/1978 | Craig | 76/108.2 |
| 4,106,577 | 8/1978 | Summers . | |
| 4,187,921 | 2/1980 | Garner . | |
| 4,189,014 | 2/1980 | Allen et al. . | |
| 4,198,210 | 4/1980 | Worley et al. | 239/591 X |
| 4,392,534 | 7/1983 | Miida . | |
| 4,512,421 | 4/1985 | Ogahara . | |
| 4,516,642 | 5/1985 | Childers et al. . | |
| 4,546,837 | 10/1985 | Childers et al. . | |
| 4,558,754 | 12/1985 | Childers et al. . | |
| 4,615,399 | 10/1986 | Schoeffler . | |
| 4,619,335 | 10/1986 | McCullough . | |
| 4,665,999 | 5/1987 | Shoemaker . | |
| 4,673,045 | 6/1987 | McCullough . | |
| 4,687,066 | 8/1987 | Evans . | |
| 4,687,067 | 8/1987 | Smith et al. . | |
| 4,723,612 | 2/1988 | Hicks | 175/393 |
| 4,738,320 | 4/1988 | Bardin et al. . | |
| 4,765,686 | 8/1988 | Adams | 175/393 X |
| 4,784,231 | 11/1988 | Higgins . | |
| 4,841,999 | 6/1989 | Danko | 239/559 X |
| 5,533,571 | 7/1996 | Surjaatmadja et al. | 166/222 |
| 5,562,171 | 10/1996 | Besson et al. . | |
| 5,579,855 | 12/1996 | Dickey . | |
| 5,853,055 | 12/1998 | Siracki et al. | 175/340 |

OTHER PUBLICATIONS

Security DBS (A division of Dresser Industries, Inc.), Specification sheet for Bit Type FM2445 of the FM2000 PDC Series. (undated).

*Primary Examiner*—Eileen Dunn Lillis
*Assistant Examiner*—Jong-Suk Lee
*Attorney, Agent, or Firm*—Groover & Associates

[57] ABSTRACT

A non-plugging nozzle and self-cleaning drilling tool incorporating the nozzle is provided. The nozzle has a body that defines a central passageway extending axially from the top to the bottom of the body. The central passageway defines an inlet orifice at the top and an exit orifice at the bottom. A side passageway extends through the side wall of the nozzle and communicates with a cylindrical portion of the central passageway, the intersection of which defines a side inlet orifice that is substantially square. Because the intersection is substantially square, particles may not become trapped within the nozzle and plug the side passageway. When incorporated into a drilling tool, particularly a polycrystalline diamond compact (PDC) bit, the drilling tool becomes self cleaning. The side passageway of the nozzle is directed at the voids formed in the cutting face of the drilling tool creating a cross flow through the voids and preventing accumulation and balling therein.

51 Claims, 3 Drawing Sheets

DRILL BIT INCLUDING NON-PLUGGING NOZZLE AND METHOD FOR REMOVING CUTTINGS FROM DRILLING TOOL

BACKGROUND OF THE INVENTION

1. Field of Invention

The present invention relates to the field of down hole equipment. More specifically, the invention relates to a non-plugging nozzle that has particular usefulness in preventing balling, or packing off in drill bits.

2. Related Art

In the drilling of oil wells, drilling fluid, or mud, provides lubrication and cooling for the drill bit and provides for removal of the cuttings from the well bore. The mud circulates down through a drill string, into the drill bit body, through nozzles positioned at the bottom of the drill bit, and toward the bottom of the well bore. In soft formations, the nozzles are particularly useful because the relatively high pressure mud creates a turbulence within the hole and stirs up formation cuttings facilitating their circulation from the well bore. From the well bore bottom, the mud circulates back to the surface carrying formation cuttings from the well bore. The process of removing the cuttings from the well bore and the efficiency with which it is accomplished is an important factor in determining the rate of penetration of the drill bit and, thus, the efficiency of the drilling. Therefore, increasing the efficiency of the removal of the cuttings increases the drilling efficiency.

Typically, drill bits define voids between the cutting surfaces. Drilling mud and formation cuttings often accumulate within the voids and form a mud ball that becomes impacted. This process, or phenomenon, of accumulation and impaction is generally referred to as "balling" or "packing off." Balling reduces the efficiency of the drilling process because a portion of the cutting energy is consumed when the cutting surfaces act on the impacted mud ball and the mud ball tends to hold weight intended for cutter penetration. Also, the ball can block the flow of fluid to the well bore bottom and impede the removal of cuttings which can often damage the drill bit. Thus, the drill bit should be designed to avoid balling.

One type of drill bit, a polycrystalline diamond compact (PDC) bit, has a plurality, normally at least three, fixed cutting surfaces that extend radially from the axis of the PDC bit, are evenly spaced from one another, and define voids therebetween. The cutting surfaces are positioned so that, as the PDC bit rotates about its axis, the cutting surfaces remove material from the well bottom. Typically, PDC bits include a nozzle directed at each of the cutting surfaces to lubricate, cool, and clean the cutting surface. Periodically, however, one or more of the nozzles often becomes plugged and fails to provide the needed drilling fluid to the associated cutting surface. With one nozzle plugged, the flow is diverted to the other nozzles and cutting blades. Additionally, even when the nozzle is not plugged, the voids between the cutting surfaces may experience balling, or packing off, within the voids. Whether a nozzle is plugged, the drill bit experiences balling, or a combination of these or other mud and flow related problems, the efficiency of the drilling and the rate of penetration is reduced.

Many different nozzles have been created to attempt to increase the efficiency of the mud flow, lubrication, and cleaning of drill bits. Among the prior efforts are nozzles that attempt to produce swirling flows, alter the pressure distribution and turbulence of the flow, or create a cross flow through the center of the drill bit (especially for rotary cone rock bits). However, although many of the previous nozzles improve the efficiency of the drilling operation, additional improvements are needed to further increase the efficiency and lower the cost of production.

One limitation associated with the design of nozzles used for drilling involved the minimum allowable hole diameters which are limited by the size of the particles in the mud. Drilling mud is filtered before being placed in the formation to remove most of the larger particles. However, because the mud circulated into the formation typically still contains relatively large particles, the passageways and nozzle exits commonly have a minimum diameter of about 10/32 inches. Passageways and nozzle exits smaller than this minimum have a tendency to clog. Plugging of the nozzle prevents the desired flow, reduces the efficiency of the process, and may cause additional damage to the drill bit. However, limiting the minimum diameter limits the flexibility of the nozzle design by effectively setting a minimum flow through the hole and limiting the allowable distribution of the nozzle. Accordingly, a non-plugging nozzle that allows the use of smaller holes is desired to improve the efficiency and flexibility of the nozzle.

Thus, despite the use of the prior art features, there remains a need for a non-plugging nozzle that may be used in connection with drill bits and that may accommodate exit holes smaller than those formally possible. Also, there is a need for an anti-clogging, self-cleaning PDC bit that also resists balling.

SUMMARY OF THE INVENTION

To achieve such improvements, the present invention generally provides a non-plugging nozzle and a self-cleaning drill bit, particularly a polycrystalline diamond compact (PDC) bit, incorporating a nozzle. In general, the nozzle has an inlet, an outlet, and a side passageway. The side passageway intersects the central passageway, particularly a cylindrical portion of the central passageway, in such a way that the intersection is substantially square. Thereby, particles within the drilling fluid, or other transmitted fluid, cannot become lodged within the relatively smaller side passageway and the nozzle is non-plugging. The nozzle may be applied to a drilling tool, such as a drill bit, to make the tool self-cleaning. Further, applying a nozzle that includes a side passageway and provides side jetting in a PDC bit makes the PDC bit self-cleaning and alleviates the risk of balling and plugging.

One aspect of the invention provides a non-plugging nozzle that includes a body having a top, a bottom, and an axis. The body defines a central passageway extending therethrough from the top to the bottom in an axial direction so that the body has a side wall. The central passageway defines an inlet aperture at the top of the body, an exit aperture at the bottom of the body, and a cylindrical portion. The body also defines a side passageway extending through the side wall intermediate the top and bottom of the body with the side passageway in flow communication with the central passageway and intersecting the cylindrical portion. A side inlet orifice is formed at the intersection of the side passageway and the central passageway and is substantially square.

In the preferred embodiment, the side passageway has a constant diameter throughout its length and in one embodiment is a straight, cylindrical bore through the side wall of the body. The side passageway has an axis that lies in a common plane with the axis of the body. To provide for side jetting, the side passageway extends through the side wall at an angle to the axis of the body may be perpendicular thereto and preferably has a minimum angle of between about ten and forty-five degrees between the axes. Note that the minimum angle allows the side passageway to direct fluid in an upward or downward direction as well as perpendicular to the axis of the body.

Typically, the central passageway has an axisymmetric shape although other shapes designed to provide a vortex-type outlet, to increase the outlet turbulence, or to otherwise affect the outlet flow are included within the scope of the present invention. Preferably, the inlet aperture of the body has a greater cross sectional area than the combined cross sectional areas of the side inlet orifice and the exit aperture of the body. Further, the side inlet orifice has a smaller diameter than the exit aperture of the body.

In one alternative embodiment, the nozzle also includes at least one additional side passageway extending through the side wall intermediate the top and bottom of the body. The at least one additional side passageway is in flow communication with the central passageway and intersects the cylindrical portion. A side inlet orifice is formed at the intersection of the at least one additional side passageway and the central passageway and is substantially square. Preferably, the inlet aperture of the body has a greater cross sectional area than the combined cross sectional areas of the exit aperture of the body and the side inlet orifices associated with the side passageway and the at least one additional side passageway. Also, the exit aperture of the body has a greater cross sectional area than the combined cross sectional areas of the side inlet orifices associated with the side passageway and the at least one additional side passageway.

Another embodiment of the invention provides a non-plugging nozzle for a drilling tool. The drilling tool includes a tool body that has a first end adapted for connection to a rotary drive member and a second end delimiting a cutting face. The cutting face defines at least one void formed in the cutting face. The nozzle includes means for functionally attaching the body to the tool body. Also the nozzle includes the features and limitations generally described above. The side passageway of the nozzle is positioned and adapted to produce a flow of fluid toward the at least one void of the drilling tool to produce a cross flow of fluid through the void so that cuttings may not accumulate in the void. The cross flow alleviates balling and plugging in the void.

An additional aspect of the present invention provides a polycrystalline diamond compact (PDC) bit. The PDC bit includes a bit body that has a first end adapted for connection to a rotary drive member and a second end delimiting a cutting face that defines at least one void. The bit body defines a fluid communication cavity therein and has at least one non-plugging nozzle functionally attached to the bit body. The inlet aperture of the nozzle is in fluid communication with the fluid communication cavity of the bit body. To provide for self-cleaning of the PDC bit, the side passageway of the nozzle is positioned and adapted to produce a flow of fluid toward the at least one void of the drilling tool. Similarly, any additional side passageways are also positioned and adapted to produce a flow of fluid toward the at least one void.

Yet another aspect of the present invention provides a method for removing cuttings from a drilling tool during operation and preventing balling, or packing off, in the drilling tool. The drilling tool comprises a tool body that has a first end adapted for connection to a rotary drive member and a second end delimiting a cutting face that defines at least one void. The drilling tool has at least one nozzle. The method comprises the steps of directing a first flow of fluid through a central passageway defined by the at least one nozzle through an exit aperture of the nozzle toward the second end of the drilling tool, directing a second flow of fluid through a side passageway defined by the at least one nozzle toward the at least one void, the side passageway in fluid communication with the central passageway, and providing a substantially square intersection between the side passageway and the central passageway so that the nozzle is non-plugging. In a preferred embodiment, the method also includes providing a cylindrical portion in the central passageway with the side passageway intersecting the cylindrical portion. Other embodiments for the method may include directing the second flow of fluid at an angle to the first, limiting the minimum angle between the first and second flows to between about ten and forty-five degrees, providing a volume of the first flow that is greater than the volume of the second flow, accelerating the fluid through the nozzle, and/or directing at least one additional flow of fluid through at least one additional side passageway defined by the at least one nozzle toward the at least one void with the at least one additional side passageway in fluid communication with the central passageway.

BRIEF DESCRIPTION OF THE DRAWINGS

The manner in which these objectives and other desirable characteristics can be obtained is explained in the following description and attached drawings in which.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

The present invention generally provides a non-plugging nozzle and a self-cleaning drill bit, particularly a polycrystalline diamond compact (PDC) bit, incorporating a nozzle. In general, the nozzle has an inlet, an outlet, and a side passageway. The side passageway intersects the central passageway, particularly a cylindrical portion of the central passageway, in such a way that the intersection is substantially square. Thereby, particles within the drilling fluid, or other transmitted fluid, cannot become lodged within the relatively smaller side passageway and the nozzle is non-plugging. The nozzle may be applied to a drilling tool, such as a drill bit, to make the tool self-cleaning. Further, applying a nozzle that includes a side passageway and provides side jetting in a PDC bit makes the PDC bit self-cleaning and alleviates the risk of balling, or packing off, and plugging.

As used herein, the term "substantially square" shall not mean that the passageways necessarily intersect at a right angle, but shall mean that the intersection of the passageways does not include any round, chamfer, taper, bevel or the like and the diameter of the side passageway, as measured perpendicular to its axis, does not vary at the intersection of the passageways. Therefore, the intersection of the side passageway to the central passageway does not create an enlarged area, or cavity, within which a particle may become embedded.

Figure 1:
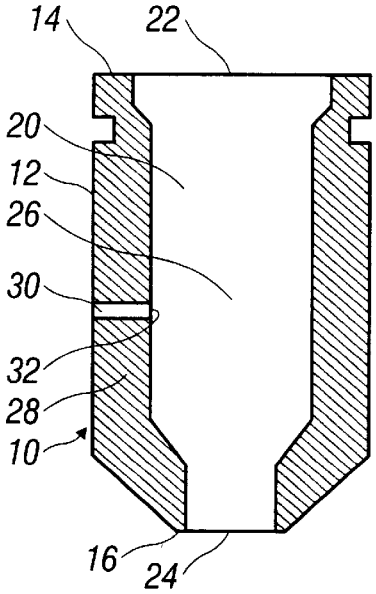
FIG. 1 is a side cross-sectional view of the non-plugging nozzle.

FIG. 1 is a side elevational, cross sectional view of the non-plugging nozzle 10. The nozzle 10 has a body 12 that has an axis and that defines a central passageway 20 extending axially from a top 14 of the body 12 to a bottom 16 of the body 12. Accordingly, the body 12 has a side wall 28. At the top 14 of the body 12, the central passageway 20 defines an inlet aperture 22 and, at the bottom 16 of the body 12, the central passageway 20 defines an exit aperture 24. Preferably, the body 12 is axisymmetric and has a circular outer cross sectional shape throughout its length, although other shapes are anticipated and may have utility in ensuring proper positioning (e.g. by using flat edges), in facilitating installation (e.g. by using a hex shape adapted to mate with a socket or other wrench), or for other purposes. Similarly, the central passageway 20 also preferably has an axisymmetric shape and a circular cross section throughout its length. Although the central passageway 20 preferably changes diameter along its length and includes tapered portions, the nozzle 10 preferably defines a cylindrical portion 26 intermediate the top 14 and the bottom 16 of the body 12 that has a constant diameter. The nozzle 10 shown in FIG. 1 has a tapered portion of the central passageway 20 proximal the top 14 of the body 12, a tapered portion proximal the bottom of the central passageway 20, and the cylindrical portion 26 therebetween. The diameter of the central passageway 20 decreases from the top 14 to the bottom 16 so that the diameter of the exit aperture 24 is smaller than the diameter of the inlet aperture 22. However, the size of the exit aperture 24 is sufficiently large that small particles 38 typically found in the application fluid (e.g. filtered drilling fluid) cannot plug the exit aperture 24. Although as discussed herein, the central cavity and the exit aperture 24 are described as having a circular cross sectional shape, the central cavity may have virtually any shape. For example, some nozzles have been developed with non-circular shapes in an effort to create a vortex in the flow or to increase the turbulence of the flow exiting the nozzle 10. These other nozzle configurations are incorporated herein and considered a part of the scope of the present invention.

The body 12 also defines a side passageway 30 extending through the side wall 28 intermediate the top 14 and the bottom 16 of the body 12. The side passageway 30 extends through the side wall 28 so that the side passageway 30 intersects the central passageway 20 and is in fluid communication therewith to provide a side jetting nozzle from the central passageway 20 to the periphery of the nozzle 10. To help prevent plugging of the nozzle 10, the side passageway 30 intersects the cylindrical portion 26 of the central passageway 20. The intersection of the side passageway 30 with the central passageway 20 defines a side inlet orifice 32 that, in the preferred embodiment, is positioned in the cylindrical portion 26 of the central passageway 20. To further prevent plugging of the nozzle 10, the side inlet orifice 32 is substantially square (as previously defined). Preferably, the diameter of the side passageway 30 is constant. Also, the side passageway 30 preferably is substantially straight, although some curvature may be useful in certain applications. Thus, in one embodiment, such as that shown in FIG. 1, the side passageway 30 comprises a straight, cylindrical bore through the side wall 28 of the body 12. In addition, the side passageway 30 generally extends in a radial direction when viewed in a cross section perpendicular to the axis of the body 12. In other words, the side passageway 30 preferably has an axis that lies in a common plane with the axis of the body 12. As the side passageway 30 provides for side jetting, the axis of the side passageway 30 lies at an angle to the axis of the body 12 and, thus, the axis of the central passageway 20. FIG. 1 shows the side passageway 30 extending through the side wall 28 in a direction perpendicular to the axis of the body 12 although the side passageway 30 may also be effective if positioned at an angle to the radial direction. However, as shown in FIGS. 2C and 3 the angle of the side passageway 30 to the axis of the body 12 may be virtually any angle, but is preferably at least between about ten and forty-five degrees as a minimum. Note that the minimum angle allows the side passageway 30 to direct fluid in an upward or downward direction as well as perpendicular to the axis of the body 12.

In an alternative embodiment (shown in FIG. 3), the nozzle 10 includes additional side passageways 36 extending through the side wall 28 intermediate the top 14 and bottom 16 of the body 12. The number of additional side passageways 36 may vary according to the particular needs of the application. Like the first side passageway 30, each of the additional side passageways 36 intersect the cylindrical portion 26 of the central passageway 20 and define a side inlet orifice 32 at the intersection that is substantially square. The additional side passageways 36 generally have the other characteristics of the first side passageway 30 such as constant diameter, direction, and positioning.

So that the fluid exiting the nozzle 10 has a greater velocity than the fluid entering the nozzle 10, the inlet aperture 22 of the body 12 has a greater cross sectional area than the combined cross sectional areas of the exit aperture 24 and side inlet orifice 32. Likewise, in the case of a nozzle 10 having additional side passageways 36, the cross sectional area of the inlet orifice has a greater cross sectional area than the combined cross sectional areas of the exit aperture 24 and the side inlet orifices 32 associated with the side passageway 30 and the additional side passageways 36. Consequently, the cross sectional area of the inlet to the nozzle 10 is greater than the combined cross sectional areas of the exits from the nozzle 10.

Typically, the amount of fluid needed for side jetting is less than the amount required in the axial direction. Therefore, the diameter of the exit orifice is greater than the diameter of the side inlet orifice 32. In those nozzles 10 having additional side passageways 36, the cross sectional area of the exit orifice is greater than the combined cross sectional areas of the side inlet orifices 32 associated with the side passageway 30 and the additional side passageways 36.

Figure 2A:
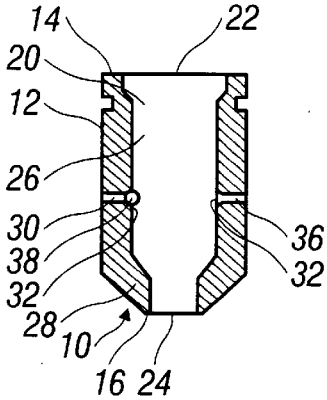
FIGS. 2A through 2C show various types of nozzles and how a small particle may or may not become lodged in the side passageway with FIG. 2C representing the present invention.
Figure 2B:
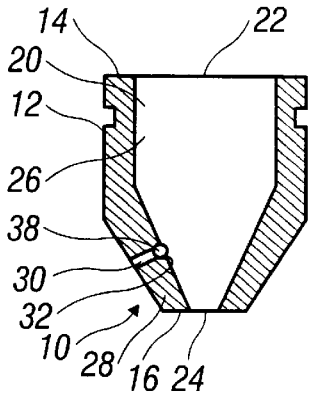
Figure 2C:
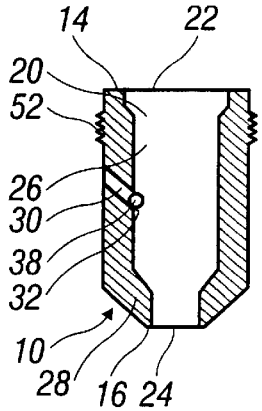
Figure 3:
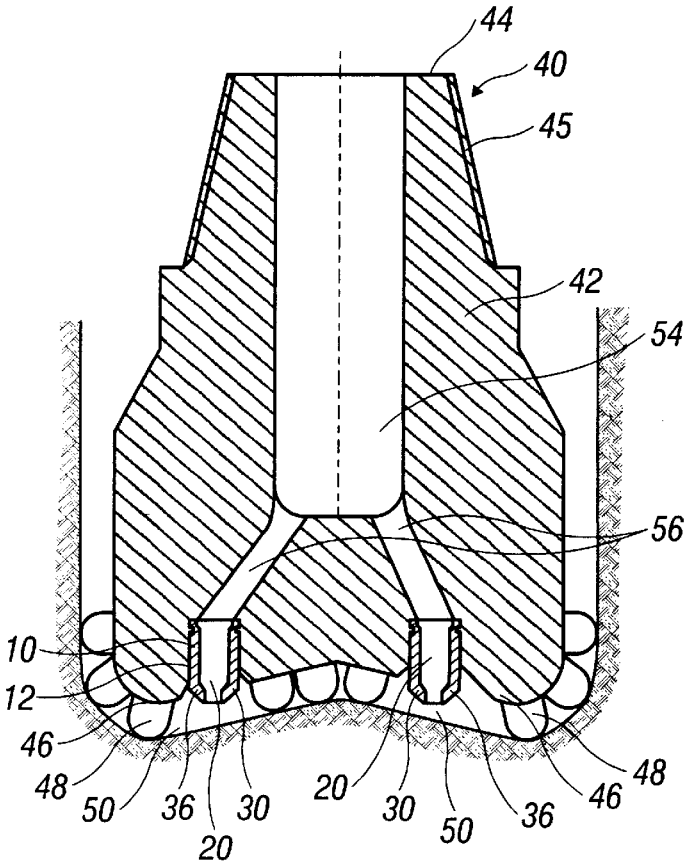
FIG. 3 is a side cross sectional view of a drilling tool incorporating the nozzle.

FIGS. 2A through 2C illustrate how the present nozzle 10 provides for non-plugging by comparing the present nozzle 10 to nozzles not having the features of the present nozzle 10. FIG. 2A shows a nozzle 10 having a side passageway 30 communicating with a cylindrical portion 26 of the central passageway 20, but wherein the side inlet orifice 32 is not substantially square. To the contrary, the side inlet orifice 32 of the nozzle 10 shown in FIG. 2A includes a round, or chamfer. Therefore, as shown in the figure, a small particle 38 traveling through the nozzle 10 may become lodged within the side passageway 30, particularly if the particle 38 has a diameter larger than the diameter of the side passageway 30 but smaller than the largest diameter of the chamfer. The chamfer creates an area within which a particle 38 may settle.

Likewise, FIG. 2B shows a nozzle 10 wherein the side passageway 30 intersects the central passageway 20 at a frustoconical (non-cylindrical) portion of the central passageway 20. This intersection of the side passageway 30 with the frustoconical portion creates a small lip against which a small particle 38 may become lodged as shown in the figure. As such, the nozzle 10 shown in FIG. 2B is not non-plugging.

FIG. 2C discloses a nozzle 10 of the present invention showing a particle 38 positioned at the side inlet orifice 32. Note that the particle 38 has a larger diameter than the side inlet orifice 32 (otherwise the particle 38 could freely pass through the side passageway 30). When positioned at the side inlet orifice 32, the particle 38 does not have an area free from the flow within which to lodge as in the nozzle 10 shown in FIG. 2A, nor does the nozzle 10 of FIG. 2C provide a lip against which the particle 38 may lodge. Therefore, as a small particle 38 contacts the side inlet orifice 32, the particle 38 will simply continue to move past the side inlet orifice 32. Note that in down hole applications, the pressure and velocity of the fluid moving through the nozzle 10 is very high. Therefore, a particle 38 positioned as that shown in FIG. 2C will be easily swept through the nozzle 10. Further, the high velocity fluid would wear down any particle 38 that did happen to partially lodge within the side passageway 30 (i.e. such as a non-uniform shaped particle 38). Although the particle 38 shown in FIG. 2B would also wear over time, the lip created by the side passageway 30 provides a greater likelihood of a particle 38 plugging the side passageway 30.

By providing a non-plugging nozzle 10 design, the side passageway 30 may have a smaller diameter than is possible with prior nozzles. Thus, a smaller portion of the flow may be directed for side jetting and a larger amount directed downward through the exit aperture 24. Also, greater pressures and velocities may be obtained with the non-plugging nozzle 10 and the nozzle 10 may accommodate more additional side passageways 36 without sacrificing flow rate through the exit aperture 24, pressure, and velocity.

FIG. 3 is a side, cross sectional view of a drilling tool 40, particularly a drill bit, having the above described nozzles 10 positioned therein. The drilling tool 40 has a tool body 42 (also referred to herein as a bit body 42 when applied to a drill bit). The tool body 42 has a first end 44 adapted for connection to a rotary drive member, such as a drill string (not shown). Typically the attachment to the rotary drive member is made using cooperating threaded connections 45. A second end 46 of the tool body 42, opposite the first end 44, defines a cutting face 48. The cutting faces 48 for different types of drilling tools vary. For example, the cutting face 48 for a rotary drill bit is different from the cutting face 48 of a polycrystalline diamond compact (PDC) bit 60. However, regardless of the type of drilling tool 40, the cutting face 48 defines at least one void 50 therein. As an example, in a rotary drill bit, the rotatably mounted rotary cutting cones are spaced from one another in a circular pattern with the points of the cones extending downward and slightly inward toward one another and define a void 50 in the center of the bit. In a PDC bit 60, the cutting members 62 of the cutting face 48 are fixed, substantially flat members that are spaced from one another and extend radially from the center of the PDC bit 60. The areas between the cutting members 62 of the PDC bit 60 are voids 50. FIG. 3 is a generic representation of a drilling tool 40 and shows the voids 50 formed in the cutting face 48.

The tool body 42 defines a fluid communication cavity 54 that is generally axially positioned and extends through the drilling tool 40. The fluid communication cavity 54 communicates with the drill string and provides for communication of the drilling fluid, or mud, through the drilling tool 40. The drilling fluid enters the drilling tool 40 through a top of the fluid communication cavity 54 and flows down through the drilling tool 40 through fluid passageways 56 defined by the fluid communication cavity 54. The fluid passageways 56 generally divide and direct the fluid toward the cutting face 48 and the well bore bottom to provide the needed lubrication, cooling, and removal of cuttings.

So that the drilling tool 40 is self-cleaning, the drilling tool 40 of the present invention incorporates the previously described non-plugging nozzles 10. At least one nozzle 10 is functionally attached to the tool body 42, preferably at or proximal the second end 46 of the drilling tool 40. The means for functionally attaching the body 12 of the nozzle 10 to the tool body 42 may comprise any one of a number of possible embodiments. Included among the many possible embodiments is a locking, cooperating thread 52, seen in FIG. 2C, that facilitates positioning of the nozzle 10 and a packing insert as disclosed in U.S. Pat. No. 5,579,855 that issued to Dickey on Dec. 3, 1996 and which is hereby incorporated herein by reference.

The attachment means attaches the nozzle 10 in the tool body 42 with the central cavity of the nozzle 10 in fluid communication with the fluid communication cavity 54 of the drilling tool 40. Preferably, the drilling tool 40 includes a plurality of nozzles 10, each communicating with a separate fluid passageway 56 of the fluid communication cavity 54. Each nozzle 10 is positioned so that the side passageway 30 (or passageways) of the nozzle 10 is directed at the adjacent void 50 and is, therefore, adapted and positioned to produce a flow of fluid toward the at least one void 50 and create a cross flow therethrough. Creating the cross flow in the void 50 prevents cuttings from accumulating in the void 50, becoming impacted, and balling. Consequently, including the non-plugging nozzles 10 in the drilling tool 40 makes the drilling tool 40 self-cleaning.

However, because creating the cross flow through the void 50 typically requires much less flow than the flow required through the exit aperture 24, the side passageways, 30 and 36, are typically much smaller than the exit aperture 24. Thus, the non-plugging nozzle 10 which allows smaller side passageways, 30 and 36, is particularly useful for this application and allows greater flexibility of drilling tool 40 design with a greater downward cleaning flow while still incorporating a self cleaning function.

Figure 4:
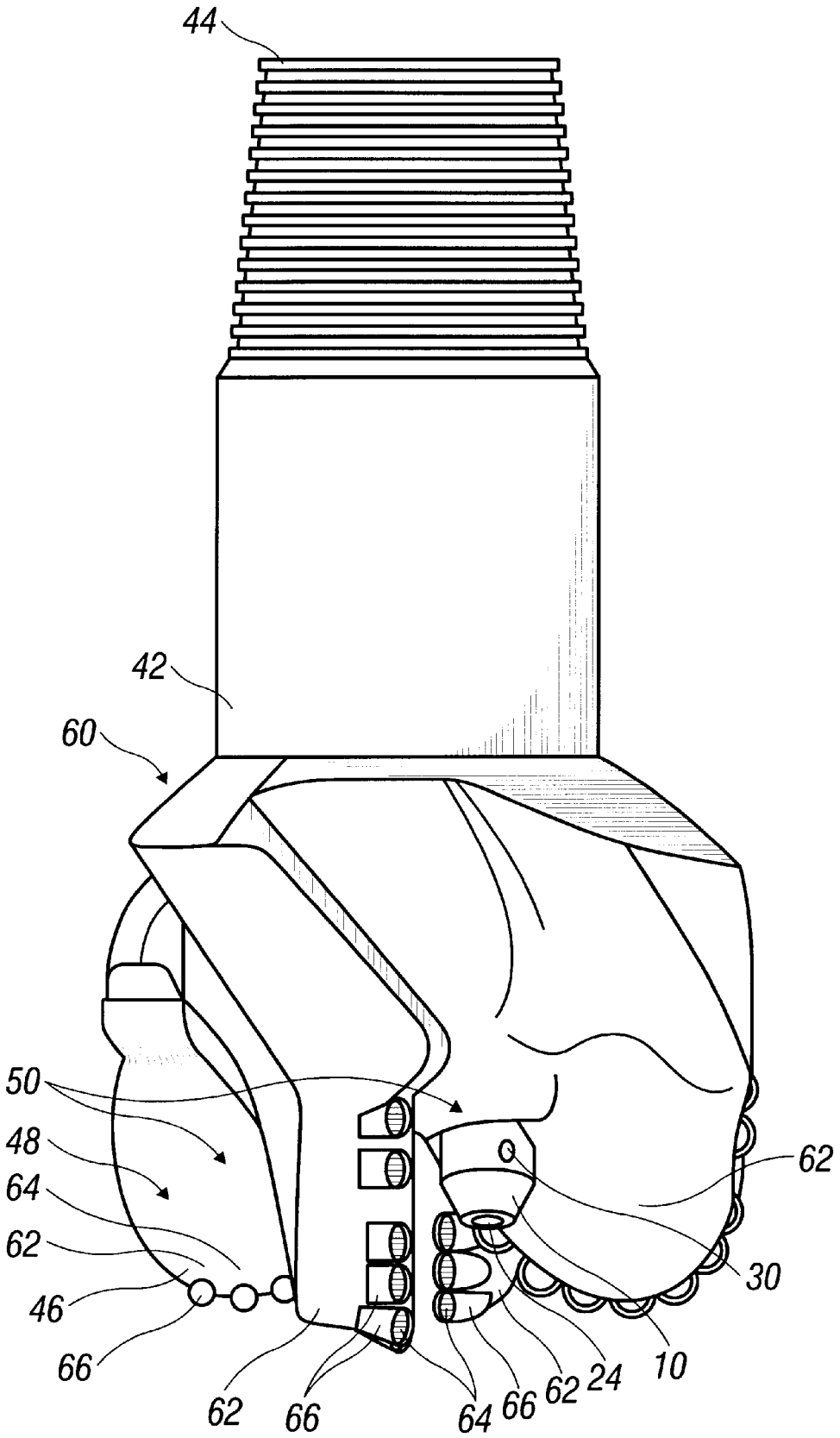
FIG. 4 is a side perspective view of a PDC bit incorporating the nozzle.
Figure 5:
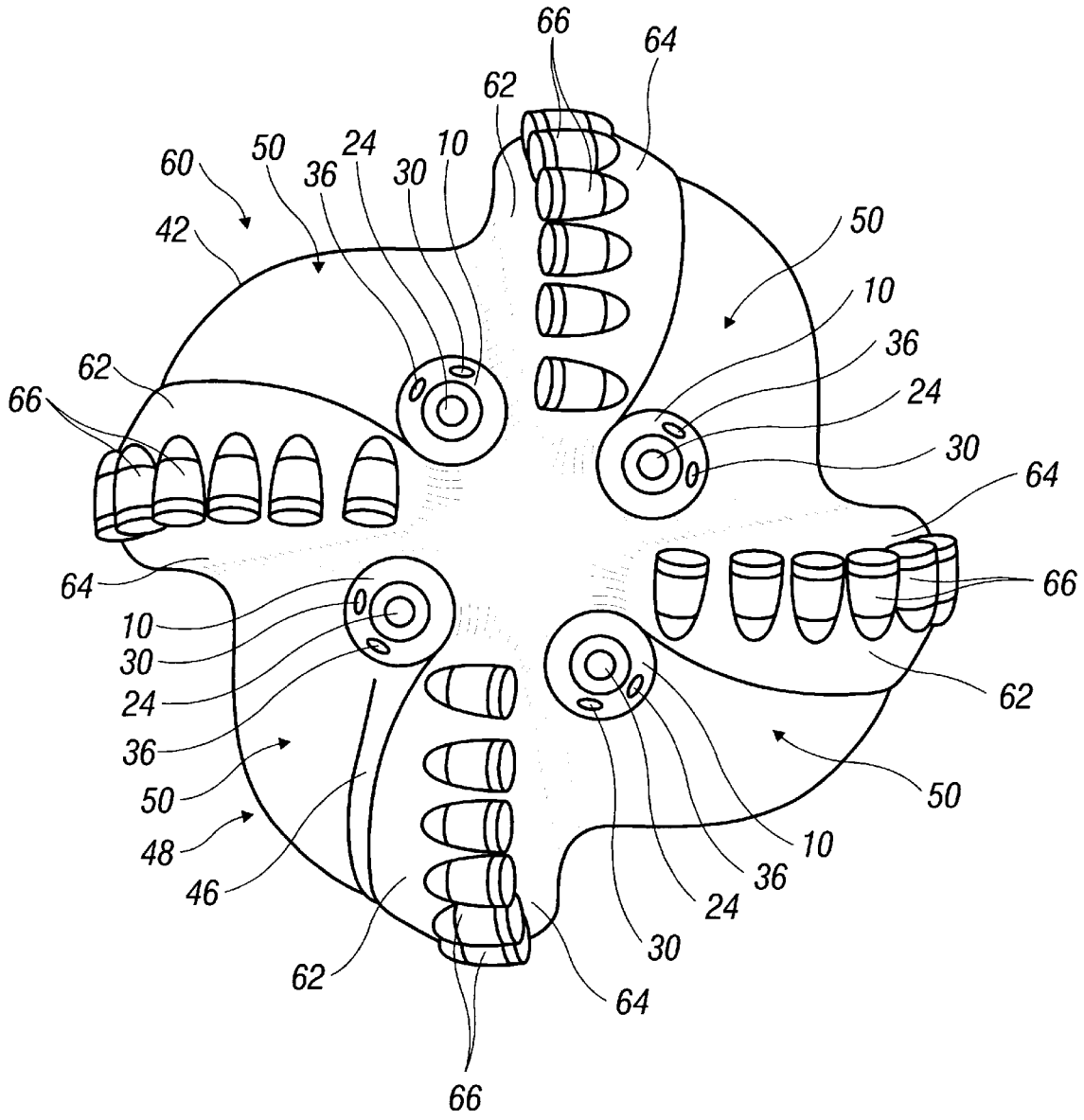
FIG. 5 is a bottom view of a PDC bit incorporating the nozzle.

In a preferred embodiment, the drilling tool 40 is a PDC bit 60. FIG. 4 is a side perspective view of a PDC bit 60 having a non-plugging nozzle 10 therein; FIG. 5 is a bottom view of the PDC bit 60 showing a plurality of non-plugging nozzles 10 positioned therein with the side passageways, 30 and 36, directed at the voids 50 of the PDC bit 60.

As in all drilling tools and as previously described, the PDC bit 60 has a tool, or bit 60, body 42 that has a first end 44 adapted for attachment to a rotary drive member and a second end 46 delimiting a cutting face 48. The cutting face 48 is made up of a plurality (generally at least three) cutting members 62. Each cutting member 62 is fixedly attached to the bit body 42 and defines a generally flat forward cutting surface 64. The forward cutting surface 64 includes a plurality of cutters 66 spaced radially along the cutting member 62. The cutting members 62 extend in a generally radial direction from the center (axis) of the PDC bit 60 and are relatively evenly spaced from one another. Thus, the cutting members 62 define a space in front of each of the forward cutting surfaces 64 to allow the cutters 66 to perform cutting during operation. The space between cutting members 62 is a void 50 in the cutting face 48.

The PDC bit 60 includes a plurality of non-plugging nozzles 10 (as previously described) attached thereto and communicating with the fluid communication cavity 54 of the PDC bit 60. To prevent packing off and plugging of the PDC bit 60 and provide for self-cleaning of the PDC bit 60, the side passageway 30 (and additional side passageways 36) of the nozzles 10 are directed at the adjacent voids 50 to create a cross flow through the void 50 that prevents material from accumulating in the void 50. The non-plugging nozzle 10 allows greater flexibility of PDC bit 60 design by providing more control of the relative flows through the nozzle 10.

In operation, the non-plugging nozzle 10 prevents balling, plugging, and accumulation in the voids 50 of the drilling tool 40, such as the PDC bit 60. The main, first flow is directed through the central passageway 20 of the nozzle 10 toward the second end 46 of the drilling tool 40 and the bottom of the well bore to provide the needed lubrication, cleaning, and cooling for the cutting operation. A second flow of fluid flows through the nozzle 10 through the side passageway 30 (and additional side passageways 36) toward the voids 50 of the drilling tool 40. By making the intersection of the side passageway 30 and the central passageway 20 substantially square, the nozzle 10 is non-plugging and smaller side passageways, 30 and 36, may be incorporated into the nozzle 10. Generally, the first flow is greater than the second flow as more fluid is typically required for cleaning than for providing a cross flow in the void 50. Also, due to the relative inlet and outlet dimensions of the nozzle 10, the fluid accelerates through the nozzle 10. Additional flows of fluid may be provided through the additional side passageways 36 of the nozzle 10 to provide better cross flow and to better clear the voids 50 of the drilling tool 40.

While the foregoing is directed to the preferred embodiment of the present invention, other and further embodiments of the invention may be devised without departing from the basic scope thereof, and the scope thereof is determined by the claims which follow.

I claim:

1. A non-plugging nozzle, comprising:

a body having a top, a bottom, and an axis, the body defining a central passageway extending therethrough from the top to the bottom in an axial direction so that the body has a side wall;

the central passageway defining an inlet aperture at the top of the body, an exit aperture at the bottom of the body, and a cylindrical portion;

the body also defining a side passageway extending through the side wall intermediate the top and bottom of the body, the side passageway in flow communication with the central passageway and intersecting the cylindrical portion; and a side inlet orifice formed at the intersection of the side passageway and the central passageway, the side inlet orifice substantially squared to prevent plugging of the nozzle;

an attachment mechanism wherein said body being removeably attached to a drill bit.

2. The nozzle as claimed in claim 1, further comprising the side passageway having a constant diameter throughout the length of the side passageway.

3. The nozzle as claimed in claim 1, further comprising the side passageway comprising a straight, cylindrical bore through the side wall of the body.

4. The nozzle as claimed in claim 1, further comprising the side passageway having an axis, the axis of the side passageway and the axis of the body lying in a common plane.

5. The nozzle as claimed in claim 1, further comprising the side passageway extending through the side wall of the body in a direction perpendicular to the axis of the body.

6. The nozzle as claimed in claim 1, further comprising:

the side passageway having an axis; and the axis of the side passageway and the axis of the body defining an angle therebetween.

7. The nozzle as claimed in claim 6, further comprising the minimum angle between the axis of the body and the axis of the side passageway is between about ten and forty-five degrees.

8. The nozzle as claimed in claim 1, further comprising the central passageway having an axisymmetric shape.

9. The nozzle as claimed in claim 1, further comprising the inlet aperture of the body having a greater cross sectional area than the combined cross sectional areas of the side inlet orifice and the exit aperture of the body.

10. The nozzle as claimed in claim 1, further comprising the side inlet orifice having a smaller diameter than the exit aperture of the body.

11. The nozzle as claimed in claim 1, further comprising:

at least one additional side passageway extending through the side wall intermediate the top and bottom of the body;

the at least one additional side passageway in flow communication with the central passageway and intersecting the cylindrical portion; and at least one additional side inlet orifice formed at the intersection of the at least one additional side passageway and the central passageway, the additional side inlet orifice substantially squared.

12. The nozzle as claimed in claim 11, further comprising the inlet aperture of the body having a greater cross sectional area than the combined cross sectional areas of the exit aperture of the body and the side inlet orifices associated with the side passageway and the at least one additional side passageway.

13. The nozzle as claimed in claim 11, further comprising the exit aperture of the body having a greater cross sectional area than the combined cross sectional areas of the side inlet orifices associated with the side passageway and the at least one additional side passageway.

14. A non-plugging nozzle for a drilling tool, the drilling tool comprising a tool body having a first end adapted for connection to a rotary drive member and a second end delimiting a cutting face having at least one void formed in the cutting face, comprising:

a body having a top, a bottom, and an axis, the body defining a central passageway extending therethrough from the top to the bottom in an axial direction so that the body has a side wall;

means for functionally attaching the body to the tool body;

the central passageway defining an inlet aperture at the top of the body and an exit aperture at the bottom of the body;

the central passageway defining a cylindrical portion;

the exit aperture positioned and adapted to produce a flow of fluid toward the second end of the drilling tool;

the body also defining a side passageway extending through the side wall intermediate the top and bottom of the body, the side passageway in flow communication with the central passageway;

the side passageway positioned and adapted to produce a flow of fluid toward the at least one void of the drilling tool; and a side inlet orifice formed at the intersection of the side passageway and the central passageway, the side inlet orifice substantially squared to prevent plugging of the nozzle;

the side passageway intersecting the cylindrical portion of the central passageway.

15. The nozzle as claimed in claim 14, further comprising the inlet aperture of the body having a greater cross sectional area than the combined cross sectional areas of the side inlet orifice and the exit aperture of the body.

16. The nozzle as claimed in claim 14, further comprising the side inlet orifice having a smaller diameter than the exit aperture of the body.

17. The nozzle as claimed in claim 14, further comprising the side passageway positioned and adapted to produce a cross flow of fluid through the at least one void of the drilling tool so that cuttings may not accumulate in the at least one void.

18. The nozzle as claimed in claim 14, further comprising:

the side passageway having an axis; and the axis of the side passageway and the axis of the body defining an angle therebetween.

19. The nozzle as claimed in claim 18, further comprising the minimum angle between the axis of the body and the axis of the side passageway is between about ten and forty-five degrees.

20. The nozzle as claimed in claim 14, further comprising:

at least one additional side passageway extending through the side wall intermediate the top and bottom of the body;

the at least one additional side passageway in flow communication with the central passageway and intersecting the cylindrical portion; and at least one additional side inlet orifice formed at the intersection of the at least one additional side passageway and the central passageway, the additional side inlet orifice substantially squared.

21. The nozzle as claimed in claim 20, further comprising the inlet aperture of the body having a greater cross sectional area than the combined cross sectional areas of the exit aperture of the body and the side inlet orifices associated with the side passageway and the at least one additional side passageway.

22. The nozzle as claimed in claim 20, further comprising the exit aperture of the body having a greater cross sectional area than the combined cross sectional areas of the side inlet orifices associated with the side passageway and the at least one additional side passageway.

23. A self-cleaning drilling tool, comprising:

a tool body having a first end adapted for connection to a rotary drive member and a second end delimiting a cutting face having at least one void formed in the cutting face;

the tool body defining a fluid communication cavity therein;

at least one nozzle functionally attached to the tool body, the nozzle comprising a body having a top, a bottom, and an axis;

the body defining a central passageway extending therethrough from the top to the bottom in an axial direction so that the body has a side wall;

the central passageway defining an inlet aperture at the top of the body and an exit aperture at the bottom of the body;

the central passageway defining a cylindrical portion;

the inlet aperture in fluid communication with the fluid communication cavity of the tool body;

the exit aperture positioned and adapted to produce a flow of fluid toward the second end of the drilling tool;

the body also defining a side passageway extending through the side wall intermediate the top and bottom of the body, the side passageway in flow communication with the central passageway;

the side passageway positioned and adapted to produce a flow of fluid toward the at least one void of the drilling tool;

the side passageway intersecting the cylindrical portion of the central passageway; and a side inlet orifice formed at the intersection of the side passageway and the central passageway, the side inlet orifice substantially squared to prevent plugging of the nozzle.

24. The tool as claimed in claim 23, further comprising the inlet aperture of the body having a greater cross sectional area than the combined cross sectional areas of the side inlet orifice and the exit aperture of the body.

25. The tool as claimed in claim 23, further comprising the side inlet orifice having a smaller diameter than the exit aperture of the body.

26. The tool as claimed in claim 23, further comprising the side passageway positioned and adapted to produce a cross flow of fluid through the at least one void of the drilling tool so that cuttings may not accumulate in the at least one void.

27. The tool as claimed in claim 23, further comprising:

the side passageway having an axis; and the axis of the side passageway and the axis of the body defining an angle therebetween.

28. The tool as claimed in claim 27, further comprising the minimum angle between the axis of the body and the axis of the side passageway is between about ten and forty-five degrees.

29. The tool as claimed in claim 23, further comprising:

at least one additional side passageway extending through the side wall intermediate the top and bottom of the body;

the at least one additional side passageway in flow communication with the central passageway and intersecting the cylindrical portion; and at least one additional side inlet orifice formed at the intersection of the at least one additional side passageway and the central passageway, the additional side inlet orifice substantially squared.

30. The tool as claimed in claim 29, further comprising the inlet aperture of the body having a greater cross sectional area than the combined cross sectional areas of the exit aperture of the body and the side inlet orifices associated with the side passageway and the at least one additional side passageway.

31. The tool as claimed in claim 29, further comprising the exit aperture of the body having a greater cross sectional area than the combined cross sectional areas of the side inlet orifices associated with the side passageway and the at least one additional side passageway.

32. A polycrystalline diamond compact bit, comprising:

a bit body having a first end adapted for connection to a rotary drive member and a second end delimiting a cutting face having at least one void formed in the cutting face;

the bit body defining a fluid communication cavity therein; at least one nozzle functionally attached to the bit body, the nozzle comprising a body having a top, a bottom, and an axis;

the body defining a central passageway extending therethrough from the top to the bottom in an axial direction so that the body has a side wall;

the central passageway defining a cylindrical portion;

the central passageway defining an inlet aperture at the top of the body and an exit aperture at the bottom of the body;

the inlet aperture in fluid communication with the fluid communication cavity of the bit body;

the exit aperture positioned and adapted to produce a flow of fluid toward the second end of the drilling tool;

the body also defining a side passageway extending through the side wall intermediate the top and bottom of the body, the side passageway in flow communication with the central passageway;

the side passageway intersecting the cylindrical portion of the central passageway;

the side passageway positioned and adapted to produce a flow of fluid toward the at least one void of the drilling tool; and a side inlet orifice formed at the intersection of the side passageway and the central passageway, the side inlet orifice substantially squared to prevent plugging of the nozzle.

33. The bit as claimed in claim 32, further comprising the inlet aperture of the body having a greater cross sectional area than the combined cross sectional areas of the side inlet orifice and the exit aperture of the body.

34. The bit as claimed in claim 32, further comprising the side inlet orifice having a smaller diameter than the exit aperture of the body.

35. The bit as claimed in claim 32, further comprising the side passageway positioned and adapted to produce a cross flow of fluid through the at least one void of the drilling tool so that cuttings may not accumulate in the at least one void.

36. The bit as claimed in claim 32, further comprising:

the side passageway having an axis; and the axis of the side passageway and the axis of the body defining an angle therebetween.

37. The bit as claimed in claim 36, further comprising the minimum angle between the axis of the body and the axis of the side passageway is between about ten and forty-five degrees.

38. The bit as claimed in claim 32, further comprising:

at least one additional side passageway extending through the side wall intermediate the top and bottom of the body;

the at least one additional side passageway in flow communication with the central passageway and intersecting the cylindrical portion; and at least one additional side inlet orifice formed at the intersection of the at least one additional side passageway and the central passageway, the additional side inlet orifice substantially squared.

39. The bit as claimed in claim 38, further comprising the inlet aperture of the body having a greater cross sectional area than the combined cross sectional areas of the exit aperture of the body and the side inlet orifices associated with the side passageway and the at least one additional side passageway.

40. The bit as claimed in claim 38, further comprising the exit aperture of the body having a greater cross sectional area than the combined cross sectional areas of the side inlet orifices associated with the side passageway and the at least one additional side passageway.

41. A method for removing cuttings from a drilling tool during operation and preventing balling in the drilling tool, the drilling tool comprising a tool body having a first end adapted for connection to a rotary drive member and a second end delimiting a cutting face having at least one void formed in the cutting face, the drilling tool having at least one nozzle, the method comprising:

directing a first flow of fluid through a central passageway defined by the at least one nozzle through an exit aperture of the nozzle toward the second end of the drilling tool;

directing a second flow of fluid through a side passageway defined by the at least one nozzle toward the at least one void, the side passageway in fluid communication with the central passageway; and providing a cylindrical portion in the central passageway, the side passageway intersecting the cylindrical portion;

providing a substantially squared intersection between the side passageway and the central passageway so that the nozzle is non-plugging.

42. The method of claim 41, further comprising directing the second flow of fluid at an angle to the first flow of fluid.

43. The method of claim 42, wherein the minimum angle between the first and second flows is between about ten and forty-five degrees.

44. The method of claim 41, further comprising the volume of the first flow greater than the volume of the second flow.

45. The method of claim 41, further comprising accelerating the fluid through the nozzle.

46. The method of claim 41, further comprising directing at least one additional flow of fluid through at least one additional side passageway defined by the at least one nozzle toward the at least one void, the at least one additional side passageway in fluid communication with the central passageway.

47. A drill bit nozzle, comprising:

a body having a main passageway therethrough, said passageway having a cylindrical portion with sidewalls parallel to the axis of said body;

a side passageway which intersects said main passageway on a sidewall of said cylindrical portion;

wherein the intersection of said passageways and said cylindrical portion does not include any round, chamfer, taper, or bevel to prevent plugging of the nozzle;

an attachment mechanism with which said body being removeably attached to a drill bit.

48. The drill bit nozzle of claim 47, wherein the diameter of said side passageway, as measured perpendicular to the axis of the side passageway, does not vary at the intersection of said passageways.

49. The drill bit nozzle of claim 47, wherein the diameter of said side passageway, as measured perpendicular to the axis of the side passageway, does not vary throughout the length of the side passageway.

50. A drill bit nozzle, comprising:

a body having a main passageway therethrough, said passageway having a cylindrical portion with sidewalls parallel to the axis of said body;

an attachment mechanism by which said body being removeably attached to a drill bit;

a side passageway which intersects said main passageway on a sidewall of said cylindrical portion;

wherein the diameter of said side passageway, as measured perpendicular to the axis of the side passageway, does not vary at the intersection of said passageways and said cylindrical portion to prevent plugging of the nozzle.

51. The drill bit nozzle of claim 50, wherein the diameter of said side passageway, as measured perpendicular to the axis of the side passageway, does not vary throughout its length.

* * * * *